US006405741B1

(12) United States Patent
McCully

(10) Patent No.: US 6,405,741 B1
(45) Date of Patent: Jun. 18, 2002

(54) WASHING APPARATUS

(76) Inventor: Peter Kevin McCully, 84 Crows Road, Swanson, Auckland (NZ)

( * ) Notice: Subject to any disclaimer, the term of this patent is extended or adjusted under 35 U.S.C. 154(b) by 0 days.

(21) Appl. No.: 09/462,923

(22) PCT Filed: Mar. 25, 1998

(86) PCT No.: PCT/NZ98/00041

§ 371 (c)(1),
(2), (4) Date: Jan. 17, 2000

(87) PCT Pub. No.: WO99/04912

PCT Pub. Date: Feb. 4, 1999

(30) Foreign Application Priority Data

Jul. 24, 1997 (NZ) ..... 328419

(51) Int. Cl.[7] ..... B08B 3/04

(52) U.S. Cl. ..... 134/186; 134/186; 134/196; 134/197; 134/144

(58) Field of Search ..... 134/136, 144, 134/196, 197, 186, 135; 396/633

(56) References Cited

U.S. PATENT DOCUMENTS

| | | | | |
|---|---|---|---|---|
| 422,049 | A | * | 2/1890 | Carter et al. |
| 467,444 | A | * | 9/1892 | Stone |
| 1,842,204 | A | * | 1/1932 | Roberts |
| 2,413,858 | A | * | 1/1947 | Borgeat |
| 3,138,098 | A | * | 6/1964 | Hungerford et al. |
| 3,139,097 | A | * | 6/1964 | Hungerford et al. |
| 3,279,482 | A | * | 10/1966 | Hungerford et al. |
| 3,444,868 | A | * | 5/1969 | Hungerford et al. |
| 3,545,458 | A | * | 12/1970 | Korb |
| 4,356,830 | A | * | 11/1982 | Holzapfel |

* cited by examiner

*Primary Examiner*—Frankie L. Stinson
(74) *Attorney, Agent, or Firm*—Andrus, Sceales, Starke & Sawall, LLP

(57) ABSTRACT

Washing apparatus for one or more fluid dispensers is disclosed. The apparatus includes a container for washing fluid, a support portion to support the fluid dispensers, and a handle which, in the preferred embodiment, may be used to force the support means and dispensers through the washing fluid in a plunging action so that the washing fluid under pressure is forced through the fluid dispensers to clean them.

17 Claims, 5 Drawing Sheets

WASHING APPARATUS

BACKGROUND

The invention relates to a washing apparatus for fluid dispensers and, in particular, although not necessarily solely, liquor dispensers such as those designed for fitment onto bottles of alcoholic beverage to dispense measured or free pour quantities of fluid.

For many years, liquor dispensers have been available for fitment onto the neck of a bottle of spirits to dispense a measured amount of the spirit such as a fluid ounce. Generally such items have comprised an item to snugly fit into the neck of the bottle and have a chamber and valve system to release a measured amount of fluid. Such items are also provided with a breather hole to allow the introduction of air into the bottle to stop any vacuum being created in the bottle and allow the fluid to flow.

Although such apparatus is useful, they generally have a relatively short life in use. The alcoholic beverage can, to a limited extent, also have a slight flow through the breather hole and tends to leave a sugar deposit in the valve components and breather hole. With previous versions of this type of dispenser, the sugar build up within the breather hold has eventually stopped the dispenser from operating correctly and a usually discarded at that time.

A more recent improvement on these liquor dispensers includes a valve on the breather hole to limit the passage of liquor through this aperture. However, such valves do not entirely stop the introduction of liquor and the resulting sugar build up in this aperture and the sugar build up can still occur even in the main aperture for the dispensing of the fluid. Although partially alleviating the problem, such apparatus may have a longer shelf-life but still eventually fails to perform.

The sugar build up can be reduced providing much greater life to such dispensers if the dispensers are regularly washed. However, this is presently a time consuming job requiring the flushing of the dispensers individually under a tap.

OBJECT OF THE INVENTION

Therefore, it is an object of the present invention to provide a washing apparatus for fluid dispensers that overcomes some of the disadvantages of the prior art or at least provide the public with a useful choice.

SUMMARY OF THE INVENTION

Accordingly, in a first aspect, the invention may broadly be said to consist in a washing apparatus for fluid dispensers including:

a containing portion for the containment of washing fluid;

a support portion to support in use at least one fluid dispenser; and means to create relative movement between said support means and said washing fluid so that said washing fluid is pressed through said fluid dispenser under pressure.

Preferably said support means includes a plurality of engagement means for the engagement and support of a plurality of fluid dispensers.

Preferably said containing portion has a cross-section substantially commensurate with that of said support portion which extends across said containing portion in use such that relative movement between said containing portion and said support portion drive said fluid through said fluid dispenser(s) held on said support means.

Preferably said support means is connected to a handle for the movement of said support means relative to said containing portion.

Further aspects of this invention which should be considered in all its novel aspects will become apparent to those skilled in the art upon reading the following description.

DETAILED DESCRIPTION OF PREFERRED EMBODIMENTS

Figure 2:
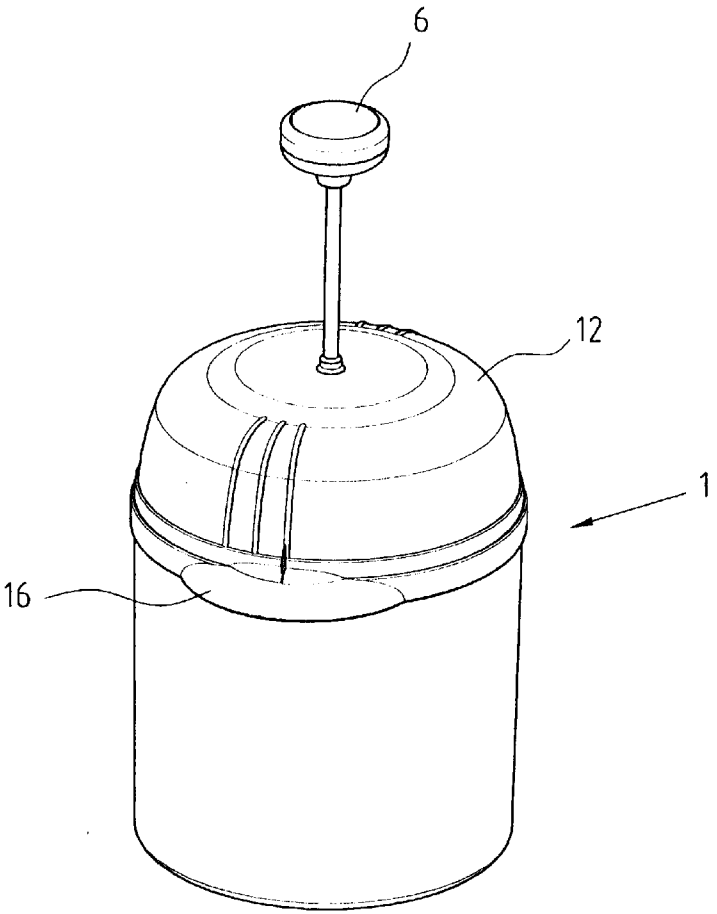
FIG. 2: shows a perspective view of the preferred embodiment of the invention with the handle in a raised position.
Figure 1:
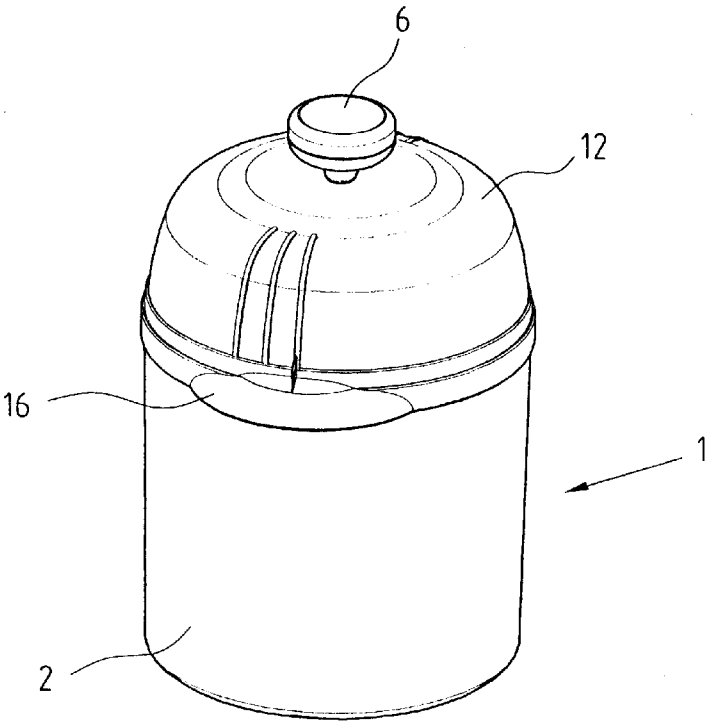
FIG. 1: shows a perspective view of the preferred embodiment of the invention with the handle in a lowered position.
Figure 3:
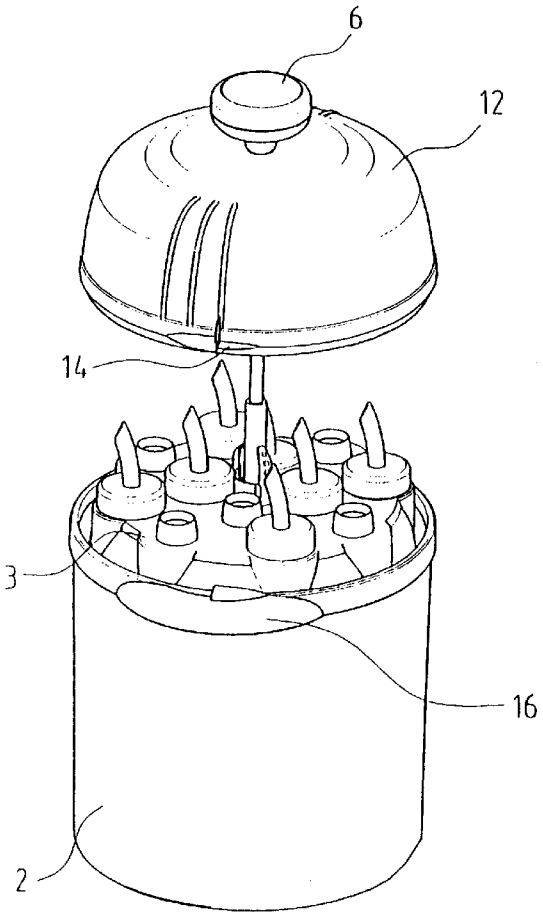
FIG. 3: shows a perspective view of the preferred embodiment of the invention with the lid removed and the support means visible and supporting dispensers.
Figure 4:
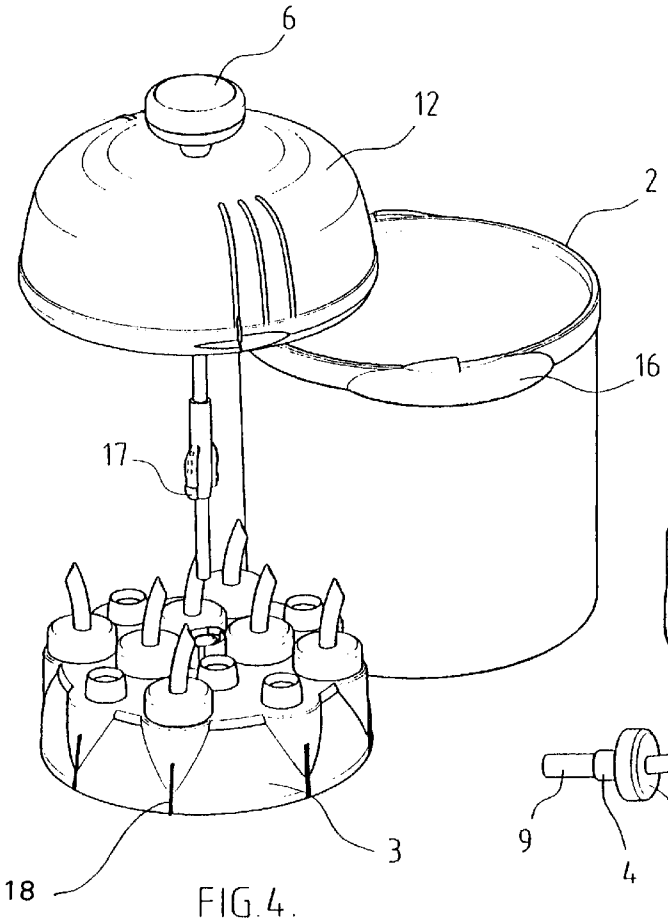
FIG. 4: shows a perspective view of the preferred embodiment of the invention with the containing portion removed and the handle detached from the support means.
Figure 5:
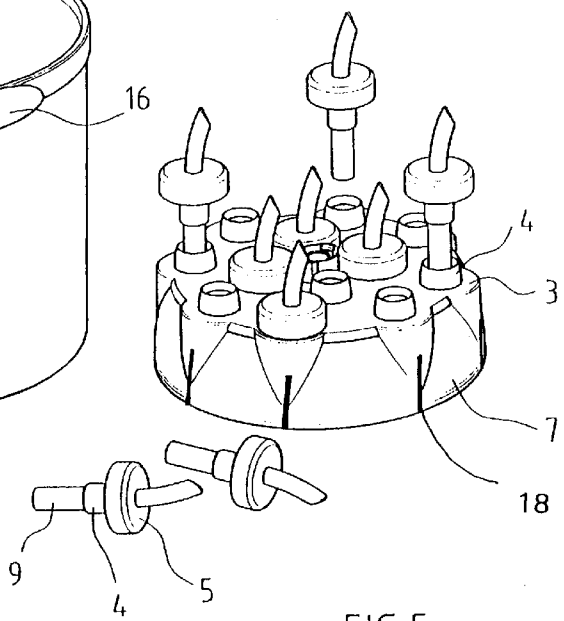
FIG. 5: shows a perspective view of the support means and the relationship of the dispensers with the support means.
Figure 8:
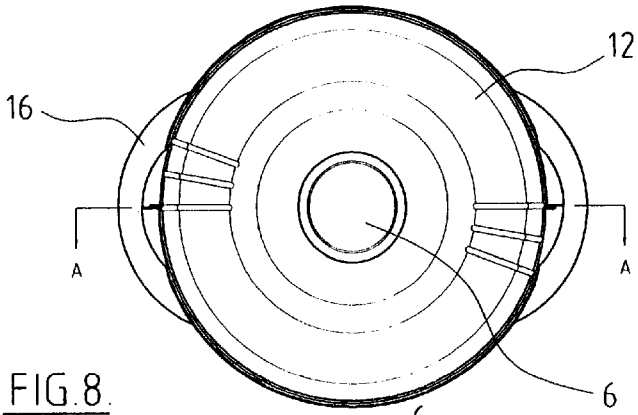
FIG. 8: shows a top view of the preferred embodiment of the invention.
Figure 7:
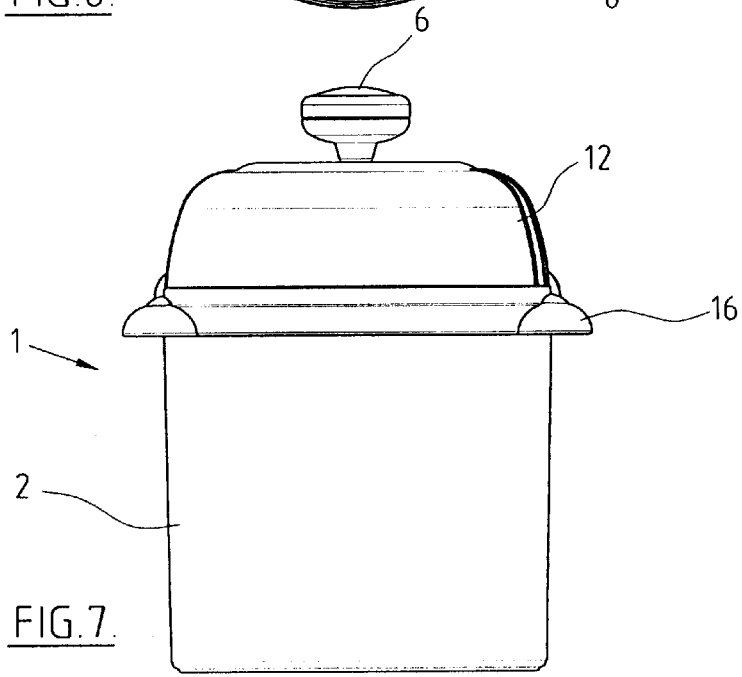
FIG. 7: shows an alternative since elevation of the preferred embodiment of the invention.
Figure 6:
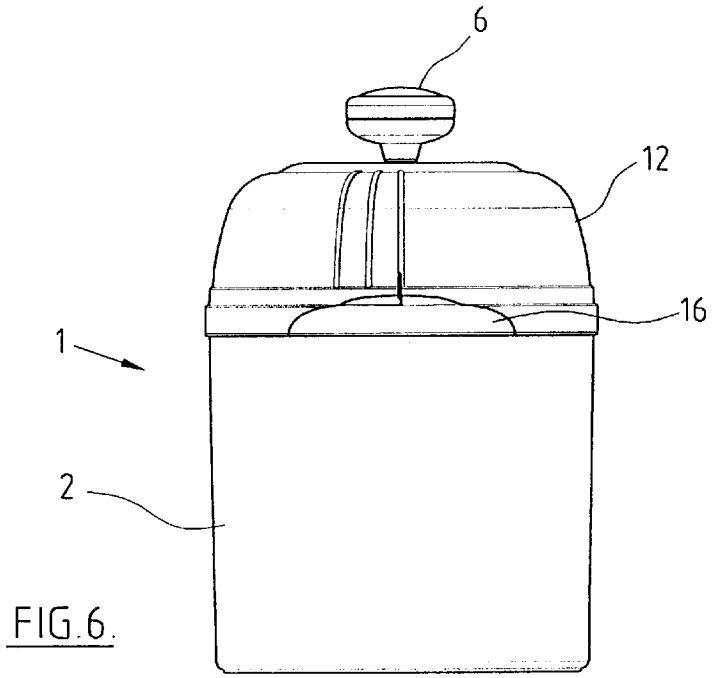
FIG. 6: shows a side elevation of the preferred embodiment of the present invention.
Figure 10:
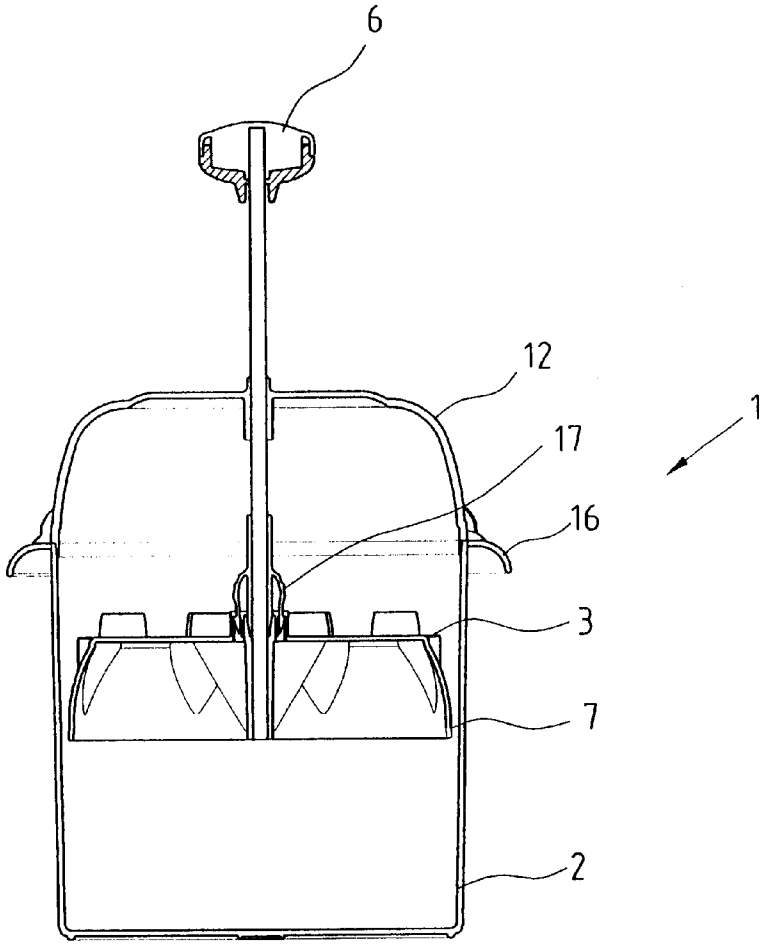
FIG. 10: shows a cut away side view of the preferred embodiment of the invention with the handle raised.
Figure 9:
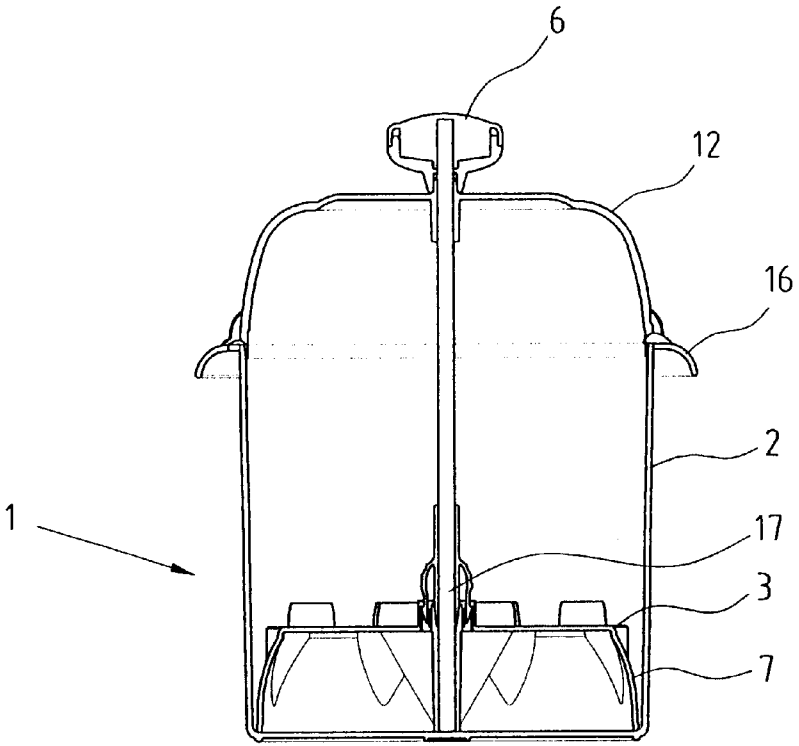
FIG. 9: shows a cut away side elevation of the preferred embodiment of the invention with the handle in a lowered position.
Figure 11:
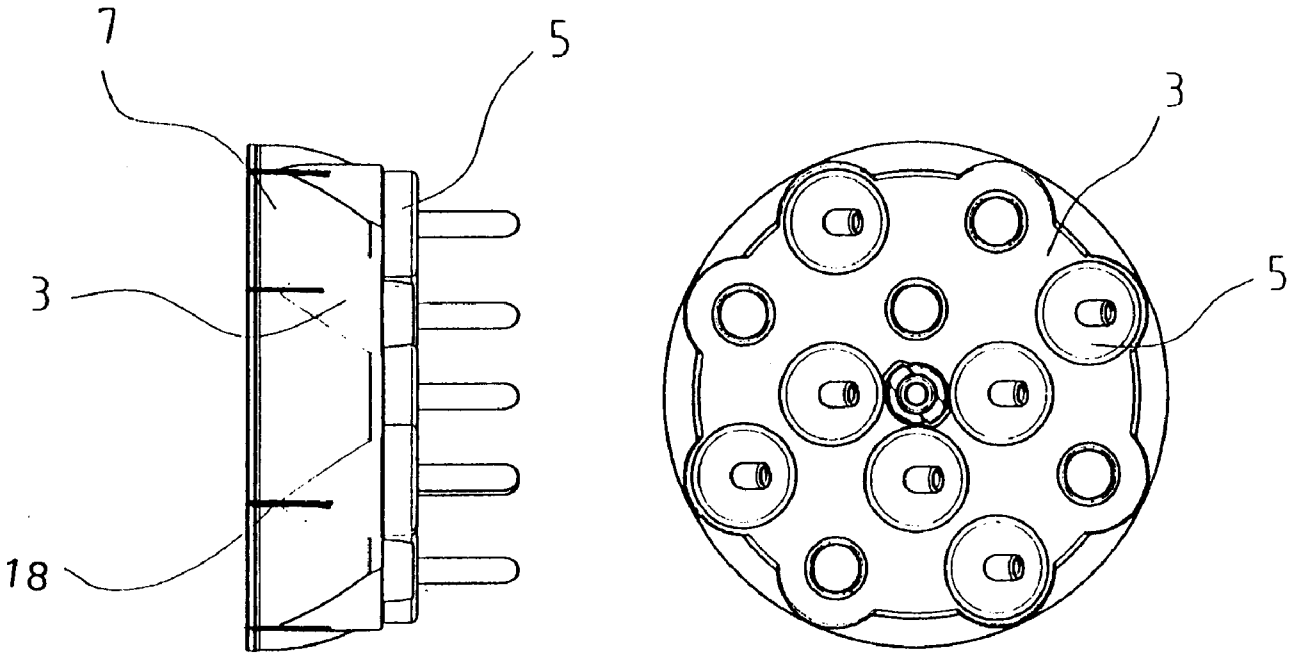
FIG. 11: shows side and plan views of the support means with dispensers.

Referring to the drawings, the washing apparatus 1 can be seen to provide a containing portion 2 having a support means 3 for the support of spirit or liquor measures or fluid dispensers of this type.

The support portion 3 is shown in partial cross-section in FIG. 2. It can be seen that it includes an aperture 4 or other suitable engagement means to engage the fluid dispenser 6. When designed for the bottle top liquor dispensers, the aperture 4 may be substantially sized on the opening at the neck of the bottles into which such dispensers are fitted.

As shown in this preferred embodiment, the support means 3 may include a plurality of apertures or engagement portions 4 to engage the fluid dispensers 8. This can allow a number of the fluid dispensers to be washed simultaneously.

The containing portion 2 may contain a suitable washing fluid which, in its simplest form may be water or, if desired, may include some specific washing agents. The washing apparatus 1 seeks to move the fluid through the dispenser 5 under some pressure to flush the sugar residues within the dispenser 5 in the case of liquor dispensers.

As shown in this example, the containing portion 2 may hold the washing fluid in a static position and the support means 3 may comprise a portion substantially extending across the cross-section of the containing portion 2 and allowing movement of the support portion 3 with respect to the containing portion 2 so that the washing fluid is forced through the fluid dispensers 5. A suitable handle attachment 8 may be provided so that the support portion 3 can be removed relative to the containing portion 2. The handle attachment 6 may be detachable from the support portion 3 by means of a detachable connection 17 thus enabling numbers of the support portions 3 to be filled up at various locations and being washed sequentially in the same apparatus 1. This texture therefore facilitates the use of a number of support portions 3 with a single handle attachment 6 and containing portion 2. In alternative embodiments, the fluid may be pushed past static support means holding the liquid dispensers. However, as the movement of the water through the liquid dispensers may comprise a more complex operation, this preferred form merely attaches a handle 8 to the support portion 3 so that the support portion 3 can be moved downward with a plunging action into the washing fluid and with the remainder of the support portion 3 generally extending across the cross-section of the containing portion 2, the washing fluid may be forced through the fluid dispensers 5.

In alternative embodiments, the support portion 3 could support the fluid dispensers 5 in a substantially transverse direction to an axis of rotation of the support portion 3 so that rotation of the support means 3 can move the fluid dispensers 5 in a rotary motion about an axis and through the washing fluid. Again, some form of restriction on the flow of the washing fluid to direct the fluid through the dispensers 5 to increase the pressure at which the fluid moves through the dispensers 5 is desirable.

Turning again to the preferred embodiment shown in the drawings, it can be seen that the support portion 3 may include a downwardly dependent flange 7 and, in this case, a stop means 8 which keep the lower and 9 of the fluid dispensers 5 from contacting the base 10 of the container 2. This flange 7 may preferably be flared outwards. This may facilitate the forcing of washing fluid through the dispensers 5 and also reduce the resistance to returning the support upwards means after a downward plunging action. Also preferably, the support means 3 may be dimensioned and shaped to leave a gap between the support means 3 and the containing portion 2 so that some washing fluid may pass around the support means to reduce resistance to the movement of the support means to a suitable level and to allow fluid to drain from above the support means prior to removal. The flange may also include ribs 18 formed on the outside of the flange 7 aligned longitudinal with the flange 7 portion to reduce the tolerance between the containing portion and the support portion.

Additionally, support ribs, not shown, may be provided to increase the rigidity of the support portion 3.

The container 2 may be provided with a lid 12 over its opening 13 to inhibit any splashing of the washing fluid out of the container 2. The handle 6 may pass axially through the container 2 and lid 12 to allow the plunging action.

The lid 12 may be provided with engagement means 14 to engage cooperating portions on the containing portion 2 and allow for some looking of the lid in piece, preferably by sliding rotation of the lid 12 relative to the containing portion. Furthermore, the handle portion 6 may be provided with an engagement means so that it may be locked relative to the lid 12 through rotation in the direction of the arrow 15. Many suitable engagement means or locking portions could be provided to provide these extra facilities. Similarly, some form of handle 16 is preferably provided on the container 2 so that the container may be securely held while the plunging action is conducted. A variety of arrangement of handles 16 may be utilised.

Although not shown in this embodiment, the support portion 3 may also be provided with a valve in its surface which is preferably a one-way valve. This may allow the fluid to be forces through the dispensers 5 while the handle 6 is pushed in a downward direction to plunge the dispensers 5 through the washing fluid. However, substantially resistance may occur in trying to raise the support means 3 by pulling on the handle 5 and, a one-way valve (not shown) to ease the raising of the apparatus within the container may be desirable.

The apparatus 1 may be made from a variety of materials such as plastics, metals, etc. As in its used in conjunction with fluid dispensers 5 that, in this preferred form, dispense a consumable product, a nontoxic material should be used throughout. Preferably the lid 12 may be formed from a transparent material.

It a yet further embodiment, the support means 3 may be detachable from the remainder of the apparatus 1. In doing an, a number of support portions 3 may be utilised in conjunction with a single containing portion 2 so that they are consecutively filled with fluid dispensers 6, washed in the containing portion 2 and the support portion 3 may be detached to allow those washed fluid dispensers to drain while a further support portion 3 is utilised to wash further fluid dispensers 5.

Although the preferred embodiment of this invention describes a manual apparatus in which the movement of the support means is conducted by a manual operation, such an apparatus could also be automated if desired. A suitable drive means such as a motor could be connected to the handle 6 or otherwise drive the relative motion of the support means 3 and the washing fluid contained within the container 2. This could include the use of a pump to move the fluid rather than the support means or the movement of the support means in a manner as described in this embodiment. An embodiment in which a rotary movement is provided for may be easily used with a drive motor. Such a drive means could also utilize a control means such as a microprocessor or other electronic control for automated operation.

Thus it can be seen that the apparatus provides a means to support the fluid dispensers 6 and pass a washing fluid such as water under some pressure through the dispensers 5 to rinse the residues that the fluid dispensers may contain. This may enhance the useable life of the fluid dispensers 5.

Where in the foregoing description reference has been made to specific components or integers of the invention having known equivalents then such equivalents are therein incorporated as if individually set forth.

Although this invention has been described by way of example and with reference to possible embodiments thereof it is to be understood that modifications or improvements may be made thereto without departing from the scope of spirit of the invention as defined in the apparent claims.

What is claimed is:

1. A washing apparatus for fluid dispensers including:

a containing portion for the containment of washing fluid;

at least one support portion to support in use at least one fluid dispenser;

movement means to create relative movement between said support means and said containing portion so that said washing fluid is passed through said fluid dispenser under pressure; and wherein the support portion includes a downwardly dependent flange which is flared outwards so that fluid may pass more easily when the support means is moving upwards than downwards, relative to the fluid.

2. A washing apparatus as claimed in claim 1, wherein said at least one support means includes a plurality of engagement means for the engagement and support of a plurality of fluid dispensers.

3. A washing apparatus as claimed in claim 1 wherein said containing portion has a cross-section substantially commensurate with that of said support portion within extends across said containing portion in use, such that relative movement between said containing portion and said support portion drives said fluid through said fluid dispenser(s) supported on said support means.

4. A washing apparatus as claimed in claim 1 wherein said movement means includes a handle connected to said support means.

5. A washing apparatus as claimed in claim 4, wherein said handle is detachable from said support means.

6. A washing apparatus as claimed in claim 5, wherein said handle includes a graspable portion and a rigid member which passes axially through said lid.

7. A washing apparatus as claimed in claim 1, wherein said movement means is adapted such that said created relative movement comprises a plunging action.

8. A washing apparatus as claimed in claim 1 further comprising a lid for said containing portion.

9. A washing apparatus as claimed in claim 8, wherein said lid includes engagement means to engage cooperating portions on the containing portion to allow the lid to be secured to the containing portion.

10. A washing apparatus as claimed in claim 9, wherein said handle includes engagement means to engage said cooperating portions on said lid.

11. A washing apparatus as claimed in claim 8 wherein the movement means passes axially through the lid.

12. A washing apparatus as claimed in claim 1, wherein at least one gap is defined between said support portion and said containing portion through which washing fluid may pass.

13. A washing apparatus as claimed in claim 1, wherein said support portion includes a one-way valve to allow fluid to pass there-through during said relative movement.

14. A washing apparatus as claimed in claim 1, wherein said at least one support portion is removable from said containing portion.

15. A washing apparatus as claimed in claim 1, wherein said relative movement is rotary.

16. A washing apparatus as claimed in claim 1, further comprising a driving means to provide said relative movement.

17. A washing apparatus as claimed in claim 16, further comprising a controlling means to control said drive means.

* * * * *